US008128262B2

(12) United States Patent
Ramer et al.

(10) Patent No.: US 8,128,262 B2
(45) Date of Patent: Mar. 6, 2012

(54) LIGHTING APPLICATIONS WITH LIGHT TRANSMISSIVE OPTIC CONTOURED TO PRODUCE TAILORED LIGHT OUTPUT DISTRIBUTION

(75) Inventors: David P. Ramer, Reston, VA (US); Jack C. Rains, Jr., Herndon, VA (US)

(73) Assignee: ABL IP Holdings LLC, Conyers, GA (US)

( * ) Notice: Subject to any disclaimer, the term of this patent is extended or adjusted under 35 U.S.C. 154(b) by 42 days.

(21) Appl. No.: 12/749,867

(22) Filed: Mar. 30, 2010

(65) Prior Publication Data

US 2011/0175527 A1 Jul. 21, 2011

(51) Int. Cl.
*F21V 5/00* (2006.01)

(52) U.S. Cl. ..... 362/327; 362/322; 362/319; 362/362; 362/800

(58) Field of Classification Search ..... 362/223, 362/216, 218, 222, 347, 350, 311.06, 631, 362/249.02, 311.02, 298, 302, 327, 322, 362/319, 323, 334, 338, 362, 363, 800–810
See application file for complete search history.

(56) References Cited

U.S. PATENT DOCUMENTS

| | | | | |
|---|---|---|---|---|
| 6,053,621 | A * | 4/2000 | Yoneda | 362/245 |
| 6,706,747 | B2 * | 3/2004 | Munk et al. | 514/370 |
| 6,969,843 | B1 | 11/2005 | Beach et al. | |
| 7,148,632 | B2 | 12/2006 | Berman et al. | |
| 7,600,882 | B1 | 10/2009 | Morejon et al. | |
| 7,768,192 | B2 | 8/2010 | Van De Ven et al. | |

FOREIGN PATENT DOCUMENTS

| | | | |
|---|---|---|---|
| DE | 10 2007 056 874 | A1 | 5/2009 |
| EP | 1 640 753 | A1 | 3/2006 |
| EP | 1 724 834 | A1 | 11/2006 |
| EP | 1 881 259 | A1 | 1/2008 |
| WO | WO 2009/146262 | A1 | 12/2009 |
| WO | WO 2010/126662 | A1 | 11/2010 |

OTHER PUBLICATIONS

International Search Report and Written Opinion of the International Searching Authority issued in International Patent Application No. PCT/US2011/027192, mailed May 25, 2011.

* cited by examiner

*Primary Examiner* — Tuyet Thi Vo
(74) *Attorney, Agent, or Firm* — McDermott Will & Emery LLP

(57) ABSTRACT

The present application relates to a lighting applications. In particular, the present application describes examples of lighting fixtures and light bulbs containing a light transmissive optic. The orientation of the solid state emitters together with the contoured output surface of the light transmissive optic produce a tailored light output distribution over a designated planar surface. The light generated by the solid state light emitters is of a sufficient intensity to illuminate the designated planar surface.

21 Claims, 13 Drawing Sheets

LIGHTING APPLICATIONS WITH LIGHT TRANSMISSIVE OPTIC CONTOURED TO PRODUCE TAILORED LIGHT OUTPUT DISTRIBUTION

TECHNICAL FIELD

The present subject matter relates to lighting applications such as fixtures and bulbs with a light transmissive optic. The light transmissive optic is contoured to produce a tailored light output distribution over a designated planar surface, typically at a distance from the lighting device.

BACKGROUND

As costs of energy increase along with concerns about global warming due to consumption of fossil fuels to generate energy, there is an every increasing need for more efficient lighting technologies. These demands, coupled with rapid improvements in semiconductors and related manufacturing technologies, are driving a trend in the lighting industry toward the use of light emitting diodes (LEDs) or other solid state light sources to produce light for lighting applications, as replacements for incandescent lighting and eventually as replacements for other older less efficient light sources.

To provide efficient mixing of the light from a number of sources and a pleasing uniform light output, Advanced Optical Technologies, LLC (AOT) of Herndon, Va. has developed a variety of lighting fixture configurations that utilize light from a number of solid state sources. By way of example, a variety of structures for AOT's lighting systems are described in US Patent Application Publications 2007/0138978, 2007/0051883 and 2007/0045524, the disclosures of which are incorporated herein entirely by reference.

These developments not withstanding, in this age of ever increasing concern over energy consumption, there is always a need for techniques to provide lighting applications that are energy efficient, but which also can generate a visibly pleasing light distribution.

SUMMARY

The teachings herein provide solid state lighting applications with a light transmissive optic that is contoured to produce tailored light output distribution over a designated planar surface, typically at a distance from the lighting application.

A lighting fixture disclosed herein provides a tailored light intensity distribution over a designated planar surface in a region or area intended to be occupied by a person. The fixture includes a light transmissive structure forming a volume. The structure has a substantially contoured outer optical output surface, wherein the outer optical output surface has a textured or etched output surface. The structure includes a peripheral portion positioned below the contoured outer optical output surface. The peripheral portion includes an optical input surface. A reflector is provided and has a diffusely reflective surface extending over at least a substantial portion of a bottom surface of the light transmissive structure to form an optical structure including the volume of the light transmissive structure. The diffusely reflective surface faces outwardly towards the optical structure. A plurality of solid state light emitters produce light of sufficient intensity for illuminating the designated planar surface. The light produced by the solid state light emitters is diffused within the volume of the light transmissive structure and emitted through the contoured outer optical output surface of the light transmissive structure. The light transmissive structure is contoured to distribute light having a distribution curve as a function of an angle from an axis, the axis having a 0° angle, and light intensity increasing toward 90° in either direction away from the axis.

By way of another example, the disclosure herein encompasses a light bulb for providing a tailored light intensity distribution over a designated planar surface in a region or area intended to be occupied by a person. The light bulb includes a light transmissive structure forming a volume. The structure has a substantially contoured outer optical output surface. The outer optical output surface has a textured or etched output surface. The structure has a peripheral portion positioned below the contoured outer optical output surface, wherein the peripheral portion has an optical input surface. A reflector is provided and has a diffusely reflective surface extending over at least a substantial portion of a bottom surface of the light transmissive structure to form an optical structure including the volume of the light transmissive structure. The diffusely reflective surface faces outwardly towards the optical structure. A plurality of solid state light emitters produce light of sufficient intensity for illuminating the designated planar surface. The light produced by the solid state light emitters is diffused within the volume of the light transmissive structure and emitted through the contoured outer optical output surface of the light transmissive structure. A heat dissipation housing is positioned below the reflector, wherein the exterior of the heat dissipation housing includes a plurality of vertically extending cooling fins positioned around the housing. The light transmissive structure is contoured to distribute light having a distribution curve as a function of an angle from an axis, the axis having a 0° angle, and light intensity increasing toward 90° in either direction away from the axis.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Figure 1:
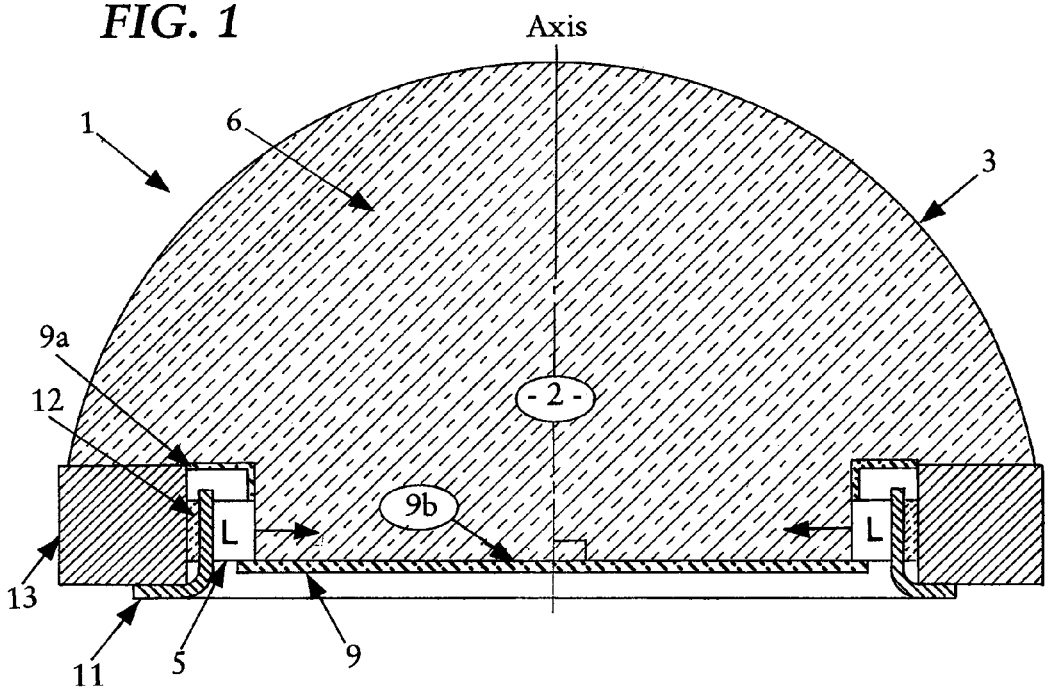
FIG. 1 is a cross-sectional view of a solid state lighting fixture, having a solid-filled optical structure, which is useful in explaining several of the concepts discussed herein.
Figure 20:
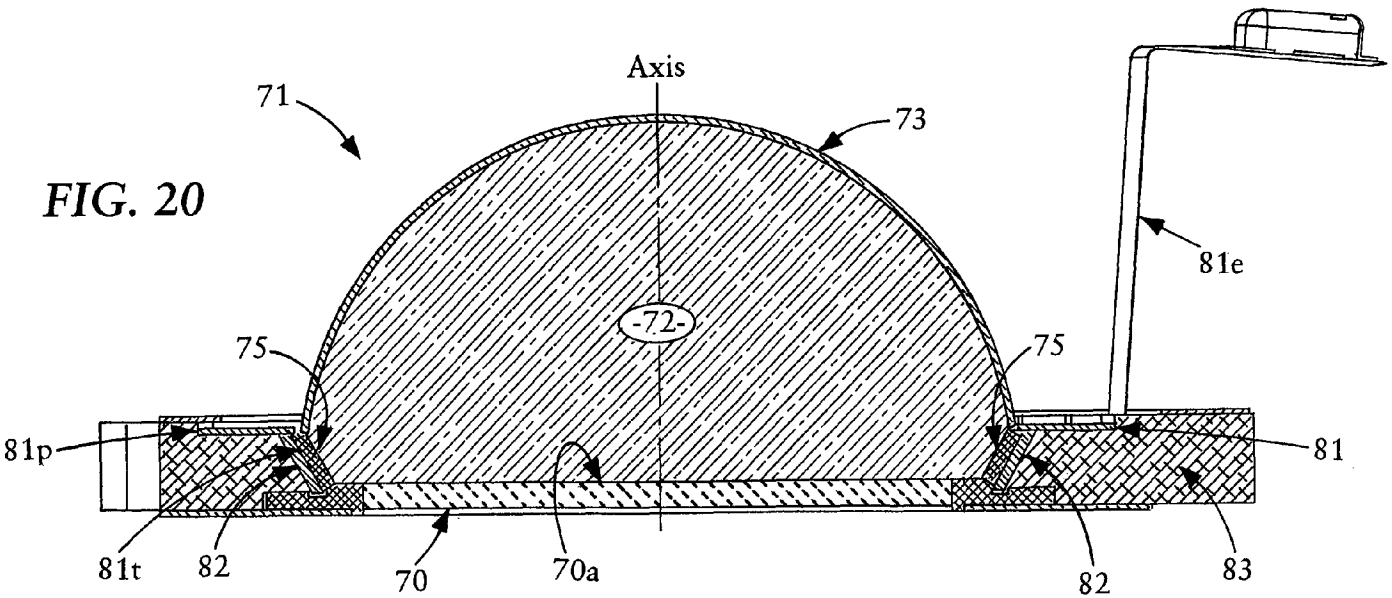
FIG. 20 is a cross-sectional view of another example of a solid state lighting fixture, having a solid-filled optical structure.
Figure 24A:
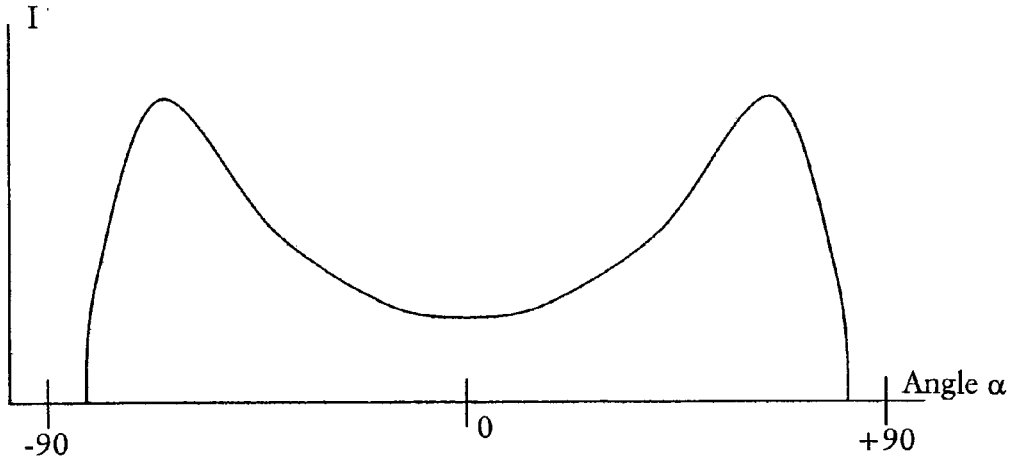
FIG. 24*a* is a graph depicting the intensity distribution of the light energy projected by the embodiments of FIGS. 1 and 20, for elevation angles ranging from −90° to +90°.
Figure 24B:
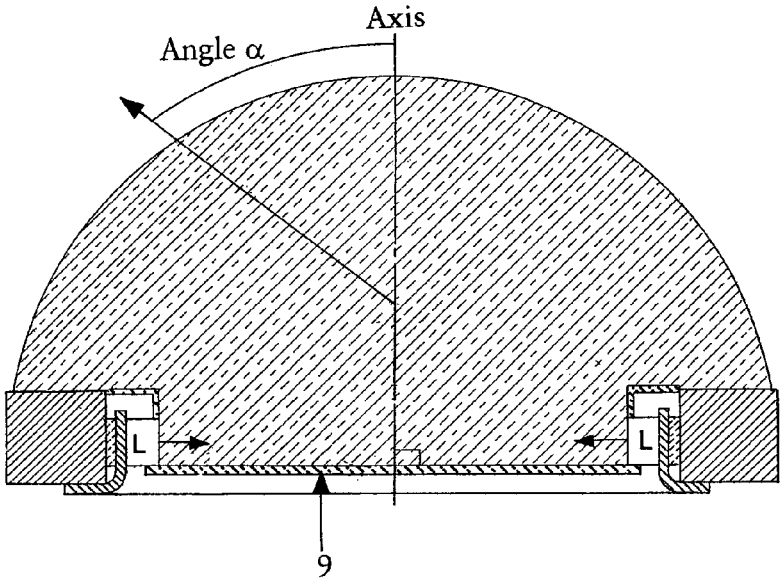
FIG. 24*b* is a cross-sectional view of a solid state lighting fixture illustrating the intensity distribution of the light energy referenced in FIG. 24*a*.

FIG. 24*a* depicts an approximation of an intensity vs. angle of emission curve, characteristic of the performance of a lighting application (e.g. fixture or bulb) constructed as shown in FIGS. 1 and 20. To achieve a desired planar uniformity of illumination, the distribution curve as a function of angle from the Axis takes the shape of a bat-wing. The illumination fixture or light bulb does produce some illumination in the region about the Axis (centered around the 0° angle), however, the intensity in this angular region is relatively low. As the Angle α increases toward 90° in either direction away from the Axis, as shown in FIG. 24*b*, the light intensity output actually increases due in part to the placement of the solid state emitters L relative to the reflector 9 and the contoured shape of the outer optical output surface. In the example shown in FIG. 24*b*, the solid state emitters L are positioned parallel to reflector 9. However, the solid state emitters L can be angled downward toward reflector 9 and produce a similar planar uniformity of illumination in the shape of a bat-wing. Further, in the example in FIG. 22, the solid state emitters 75 are angled upward away from the reflector 9 and produce a similar planar uniformity of illumination in the shape of a bat-wing.

Figure 2:
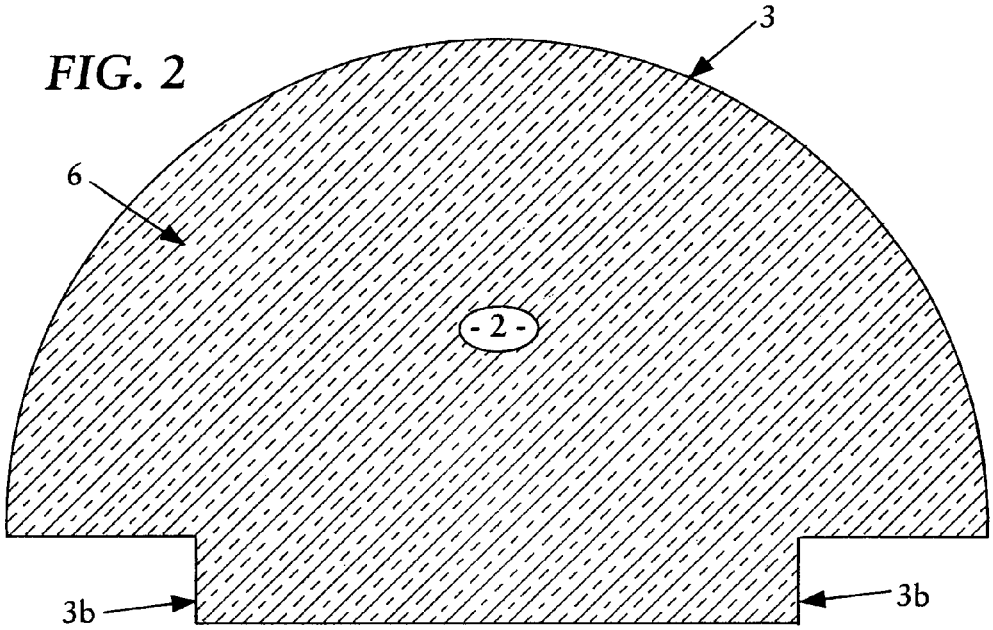
FIG. 2 is a cross-sectional view of a one-piece solid construction of the light transmissive structure, used in the fixture of FIG. 1.
Figure 3:
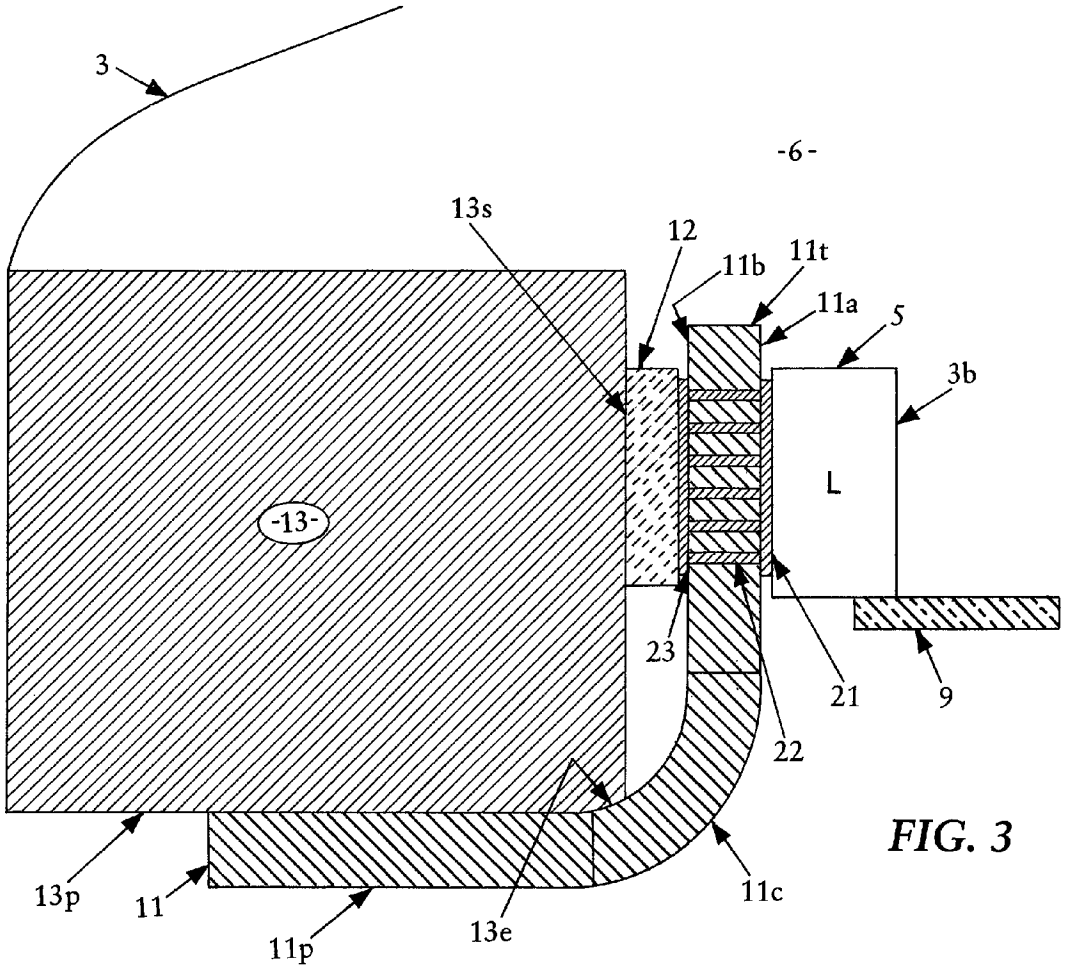
FIG. 3 is an enlarged portion of the cross-section of the fixture of FIG. 1, showing several elements of the fixture in more detail.
Figure 4:
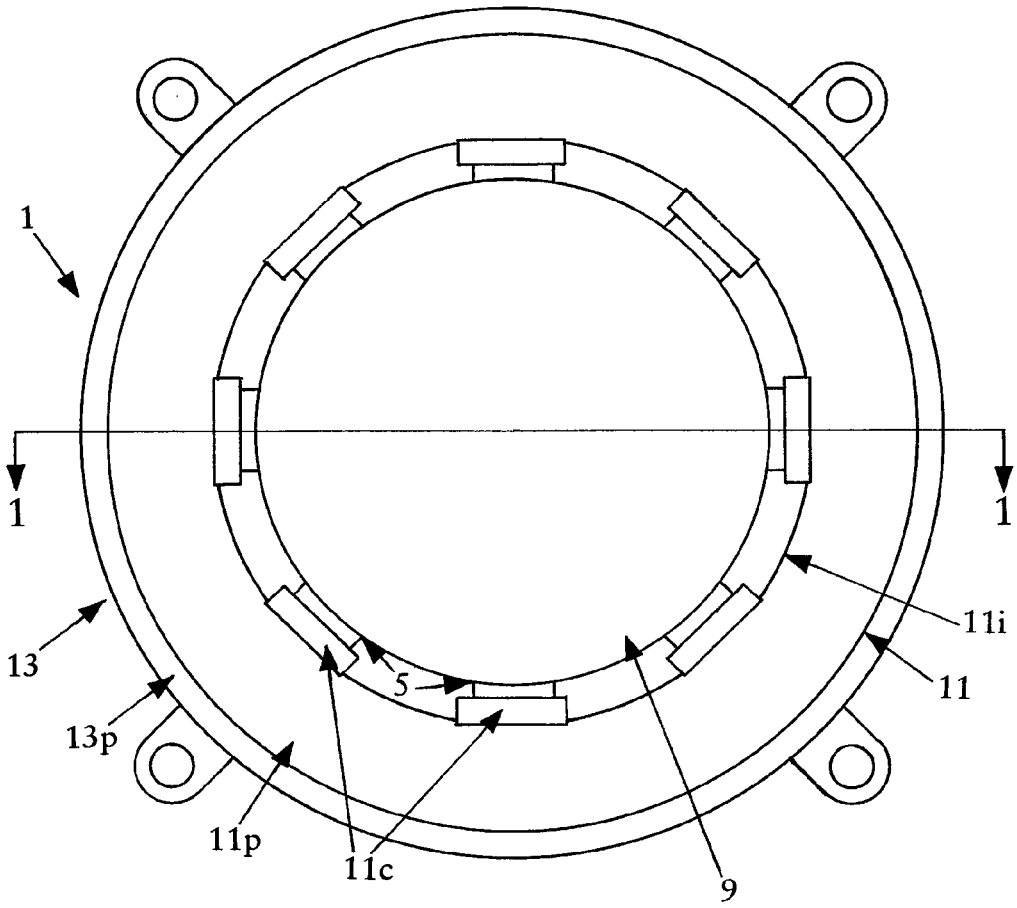
FIG. 4 is a bottom view of the solid state lighting fixture of FIG. 1.
Figure 7:
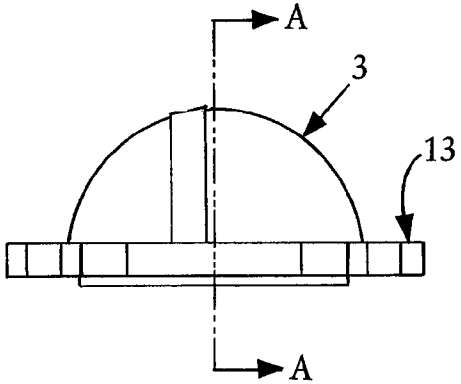
FIG. 7 an end view of the LED type lighting fixture of FIG. 5.
Figure 6:
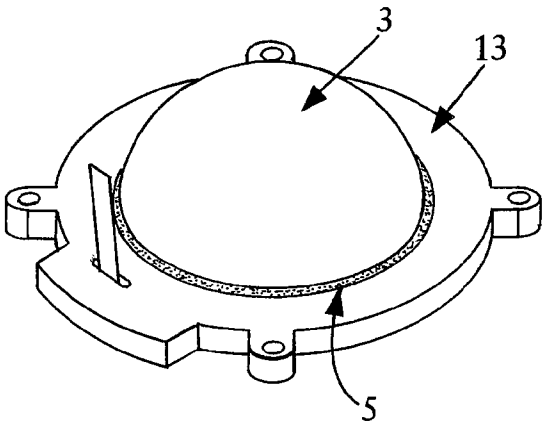
FIG. 6 is an isometric view of the LED type lighting fixture of FIG. 5.
Figure 5:
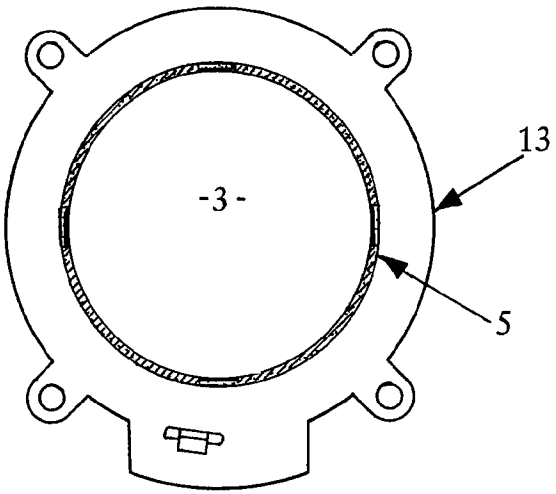
FIG. 5 is a top plan view of an LED type lighting fixture, illustrating a product that embodies a number of the concepts discussed herein.
Figure 9:
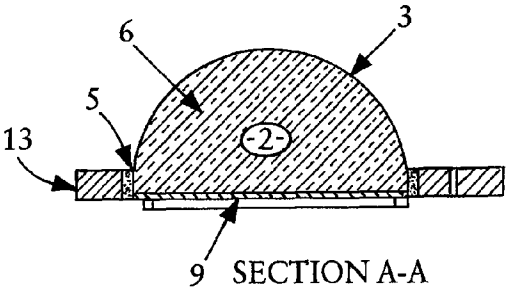
FIG. 9 is a cross-sectional view of the LED type lighting fixture of FIG. 5, taken along line A-A of the end view of FIG. 7.
Figure 8:
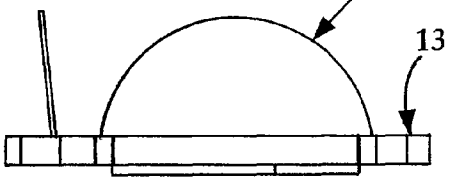
FIG. 8 a side view of the LED type lighting fixture of FIG. 5.
Figure 10:
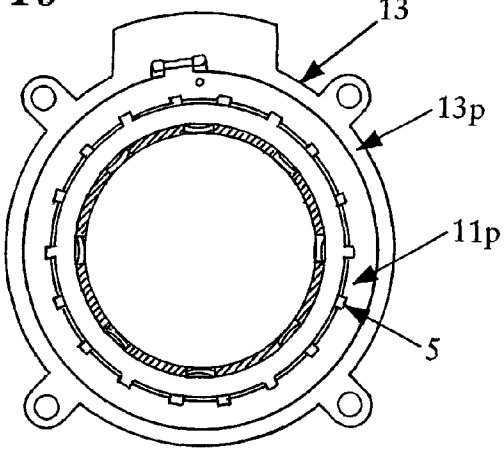
FIG. 10 is a bottom view of the LED type lighting fixture of FIG. 5.

Reference now is made in detail to the lighting application examples illustrated in the accompanying drawings and discussed below. FIG. 1 is a somewhat stylized representation of a cross-section of a first example of a lighting fixture 1 which provides a tailored light intensity distribution over a designated planar surface in a region or area intended to be occupied by a person, in accordance with the principles discussed above for FIGS. 24*a* and 24*b*. FIG. 2 is a cross-sectional view of a one-piece solid construction of the light transmissive structure 6 that forms the optical volume 2, in the fixture 1 of FIG. 1. The light transmissive structure in FIG. 2 has a generally hemispherical shape with a cylindrical bottom extension, approximately in the form of a rivet/plug or mushroom cap with a stem. FIG. 3 is a detailed/enlarged view of a portion of the general lighting fixture 1, useful in explaining aspects of the flexible circuit board 11 and heat sink member 13. FIG. 4 is a bottom view ('bottom' in terms of the exemplary downlight orientation of FIG. 1) of the lighting fixture 1. These and other drawings are not drawn to scale. In the lighting fixture of FIG. 1, light is emitted from the solid state emitter 5 through the input surface 3*b* (FIG. 2) at the periphery of the structure 6 such that a tailored light intensity distribution is provided over a designated planar surface. The distribution curve as a function of angle from the Axis takes the shape of a bat-wing, The fixture 1 includes a light transmissive structure 6 forming a volume 2. As shown in FIG. 2, the structure 6 has a contoured outer optical output surface 3. At least the contoured outer optical surface 3 is substantially rigid. The contoured outer optical output surface 3 has a roughened or etched texture (e.g. frosted) and is comprised of an optically transmissive glass or acrylic plastic. In the example, the output surface 3 is contoured and its surface is frosted, has a diffusely translucent finish or can be covered by a transmissive white diffuser or the like.

As discussed in detail with regard to FIGS. 1 to 4, but applicable to all of the examples, substantially hemispherical shapes for the light transmissive structure 6 and volume 2 are shown and discussed, most often for convenience. Hence, in the example of FIGS. 1 to 4, contoured outer optical output surface 3 approximates a hemisphere with a cylindrical extension. Examples having shapes corresponding to a portion or segment of a sphere or cylinder are preferred for ease of illustration and/or because curved surfaces provide better efficiencies than other shapes that include more edges and corners which tend to trap light. Those skilled in the art will understand, however, the volume of the light transmissive structure, and thus the optical structure of the fixture, may have any shape providing adequate reflections within the volume/cavity for a particular application.

Hence, the exemplary fixture 1 uses a structure 6 forming a substantially hemispherical optical volume 2. When viewed in cross-section, the light transmissive structure 6 therefore appears as approximately a half-circle with a bottom rectangular extension. This shape is preferred for ease of modeling, but actual products may use somewhat different curved shapes. For example, the contour may correspond in cross section to a segment of a circle less than a half circle or extend somewhat further and correspond in cross section to a segment of a circle larger than a half circle. Also, the contoured portion may be somewhat flattened or somewhat elongated relative to the illustrated axis of the aperture, the output surface 3 and the exemplary solid 6 (in the vertical direction in the exemplary orientation depicted in FIGS. 1 and 2).

Figure 22:
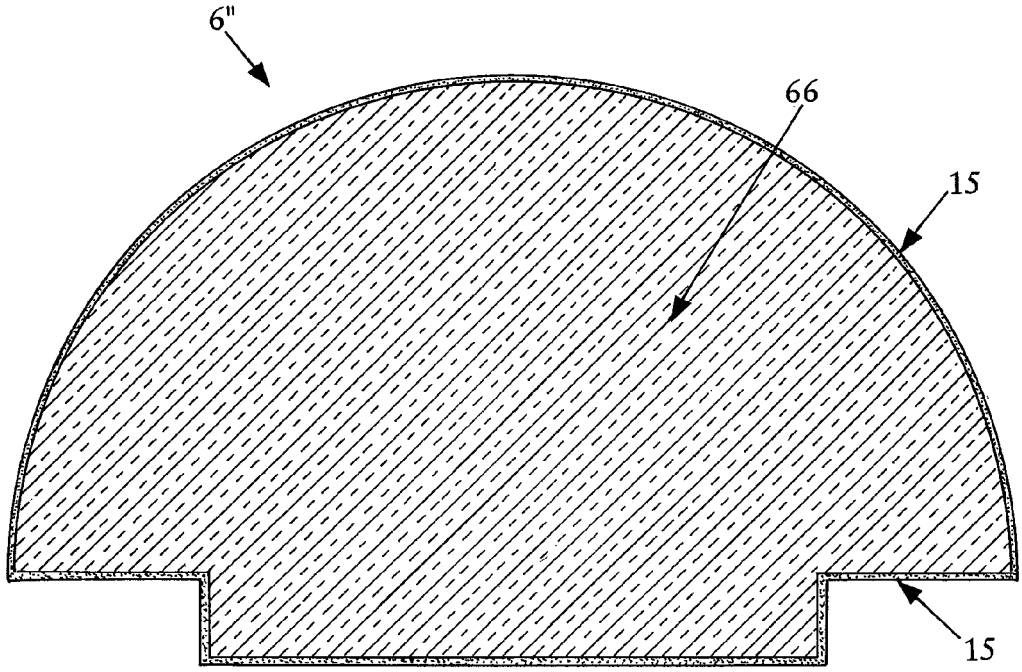
FIG. 22 is a cross-sectional view of a light transmissive structure in the form of a container filled with a liquid.

Although other arrangements of the light transmissive structure are discussed more, later, in this first example, the light transmissive structure forming the volume 2 comprises a one piece light transmissive solid 6 substantially filling the volume 2. The light transmissive structure can be a hollow vacuum cavity, or a liquid or gas filled container (FIG. 22). Other examples of the light transmissive structure include a gel. Materials containing phosphors may be provided within or around the light transmissive structure. Gaps between the plurality of solid state emitters 5 can be coated with phosphor. Further, the surface of one or more of the solid state emitters can be coated with phosphor. In the example of FIGS. 1 to 4, the solid 6 is a single integral piece of light transmissive material. The material, for example, may be a highly transmissive and/or low absorption acrylic having the desired shape. In this first example, the light transmissive solid structure 6 is formed of an appropriate glass.

The glass used for the solid of structure 6 in the exemplary fixture 1 of FIG. 1 is at least a BK7 grade or optical quality of glass, or equivalent. For optical efficiency, it is desirable for the solid structure 6, in this case the glass, to have a high transmissivity with respect to light of the relevant wavelengths processed within the optical structure 2 and/or a low level of light absorption with respect to light of such wavelengths. For example, in an implementation using BK7 or better optical quality of glass, the highly transmissive glass exhibits 0.99 internal transmittance or better (BK7 exhibits a 0.992 internal transmittance).

The fixture 1 also includes a reflector 9, which has a diffusely reflective interior surface 9*b* extending over at least a substantial portion of a bottom surface of the light transmissive structure 6 to form an optical structure including the volume 2 of the light transmissive structure. For optical efficiency, there is little or no air gap between the diffusely reflective interior surface 9*b* of the reflector 9 and the corresponding bottom surface portion of the light transmissive structure 6. In this way, the diffuse reflective surface 9*b* forms an optical structure from and/or encompassing the volume 2 of the light transmissive structure 6.

It is desirable that the diffusely reflective surface 9*b* of the reflector 9 have a highly efficient reflective characteristic, e.g. a reflectivity equal to or greater than 90%, with respect to the relevant wavelengths. Diffuse white materials exhibiting 98% or greater reflectivity are available. The illustrated example of FIGS. 1 to 4 utilizes Valar® as the reflector 9. Valar® initially comes in flat sheet form but can then be vacuum formed into desired shapes. Those skilled in the art will recognize that other materials may be utilized to construct the reflector 9 to have the desired shape and optical performance. Various reflective paints, powders and sheet materials may be suitable. The interior surface 9*b* of the reflector 9 may be diffusely reflective, or one or more substantial portions may be diffusely reflective while other portion(s) of the surface may have different light reflective characteristics, such as a specular or semi-specular characteristic. Reflector 9*a* is an example of a second optional reflector positioned adjacent to the heat sink members 13 (optional) and above the solid state emitters 5.

At least a portion (FIG. 1) of the output surface 3 of the light transmissive structure 6 serves as a transmissive optical passage or effective "optical aperture" for emission of light, from the optical volume 2, such that a tailored light intensity distribution over a designated planar surface is produced. The entire surface 3 of the solid structure 6 can provide light emission. Again, a light distribution curve as a function of angle from the Axis takes the shape of a bat-wing. The optical volume 2 operates as an optical structure (albeit one filled with the light transmissive solid of structure 6), and the passage for light emission forms the optical aperture of that cavity.

In the example, the lighting fixture 1 also includes one or more solid state light emitters 5, for producing light of sufficient intensity for illuminating a designated planar surface. An emitter 5 may be any appropriate type of light emitting semiconductor based device. In the specific examples discussed herein the solid state light emitters are white light emitting diodes (LEDs). Various combinations of different colors of LEDs (red, green, blue, and near UV) may be used. For example, near UV LEDs can be matched with an appropriate phosphor such as doped Q-dots (discussed further below) to obtain white light output. However, for simplicity, the discussion of this example will assume that the LED type solid state light emitters 5 are white light LEDs rated to all emit the same color temperature of white light. Appropriate phosphors are added to the fixture to enhance desirable white light output. Hence, in the illustrated example of the circuitry (FIG. 21 as discussed, later), each LED is a white LED of the same or similar model. As noted, there may be as few as one solid state emitter, however, for illustration and discussion purposes, we will assume in most instances below that the fixture includes a plurality of solid state emitters 5.

An index matching material, such as an optical grease, of an appropriate refractive index may be applied between the light emitting surfaces of the LED type solid state emitters 5 and the corresponding segments of the outer peripheral portion 3*b* (FIGS. 2-3) of the light transmissive structure 6. Use of such a grease may improve optical extraction of light from the package encapsulating the LED chip and thus the coupling of light from each emitter into the light transmissive structure 6. Other examples of index matching material include adhesives or silicones.

The exemplary lighting fixture 1 also includes a flexible circuit board 11. As shown in greater detail in FIG. 3, the flexible circuit board 11 has a mounting section or region 11*p* that is at least substantially planar (and is therefore referred to herein as a "planar" mounting section) for convenience in this example. As shown in the bottom view of FIG. 4, the planar mounting section 11*p* has an inner peripheral portion 11*i*. In this first example, the solid forming the light transmissive structure 6 is roughly or substantially hemispherical with a cylindrical bottom extension. The inner peripheral portion 11*i* of the flexible circuit board 11 has a shape substantially similar to the shape of the outer periphery 3*b* of the light transmissive structure 6. The circular inner peripheral portion 11*i* of the flexible circuit board 11 has a size slightly larger than the outer peripheral portion 3*b* of the light transmissive structure 6. The flexible circuit board 11 also has flexible tabs 11*t* (FIGS. 1 and 3) attached to and extending from the inner peripheral region of the flexible circuit board 11. As is shown in FIGS. 3 and 4, a portion 11*c* of each tab forms a curve.

The number and type of LED type solid state light emitters 5 used in the fixture are selected so as to produce light of sufficient intensity for illuminating the designated planar surface. The emitters 5 are mounted on the tabs 11*t*. At least one of the solid state light emitters 5 is mounted on a first surface 11*a* of each of the tabs 11*t* of the flexible circuit board 11.

The fixture 1 also optionally includes a heat sink member 13.*to* provide efficient heat dissipation. The heat sink member 13 is constructed of a material with good heat conduction properties and sufficient strength to support the flexible circuit board and associated LED light emitters, typically a metal such as aluminum. Cooling fins, although not shown in this example, may be coupled to the heat sink member 13. In the light bulb example of FIG. 19, a plurality of cooling fins 50 are coupled to heat sink members 13.

As noted earlier, a fixture of the type under consideration here may include only one solid state emitter, so long as the desired light intensity curve (shape of a bat wing) discussed above is achieved. In such a case, the flexible circuit board may have only one tab supporting the one emitter. Alternatively, the board may have more tabs, either supporting other elements, such as one or more sensors, or provide spacers for proper alignment of the board and heat sink member in relation to the light transmissive solid. Since we are mainly discussing examples having some number of (plural) emitters, each illustrated example also includes a number of flexible tabs.

The heat sink member 13 has an inner peripheral portion of substantially similar shape and of a size slightly larger than the outer peripheral portion 3*b* of the light transmissive structure 6, in this case, a circular inner peripheral portion. Hence, in the example of FIGS. 1 to 4, the heat sink member 13 is essentially a ring configured to surround the light transmissive structure 6. The inner periphery of the heat sink member 13, e.g. at inner edge 13*e* and/or surface 13*s*, corresponds in shape to the shape of the outer periphery of the light transmissive structure 6. The outer periphery of the heat sink member 13 may have any convenient shape, although in the example, it is essentially circular with a number of eyelets for screws or other fasteners to mount the fixture (see FIG. 4).

The ring shaped heat sink member 13 in the example is a single solid member. Those skilled in the art will realize that other configurations may be used. For example, there may be a cut on one side of the ring and a tightening member (e.g. screw or bolt) attached through extensions or shoulders on either side of the cut to provide adjustment or tightening of the ring shaped heat sink member 13 around the outer periphery of the hemispherical light transmissive structure 6. Another approach would be to utilize a two or three piece arrangement of the heat sink member 13 with fasteners to couple the pieces of the member to form the ring around the outer periphery of the hemispherical light transmissive structure 6. A variety of shapes/contours may be used for the heat sink member instead of the relatively flat or planar ring shown and discussed by way of example here.

Figure 21:
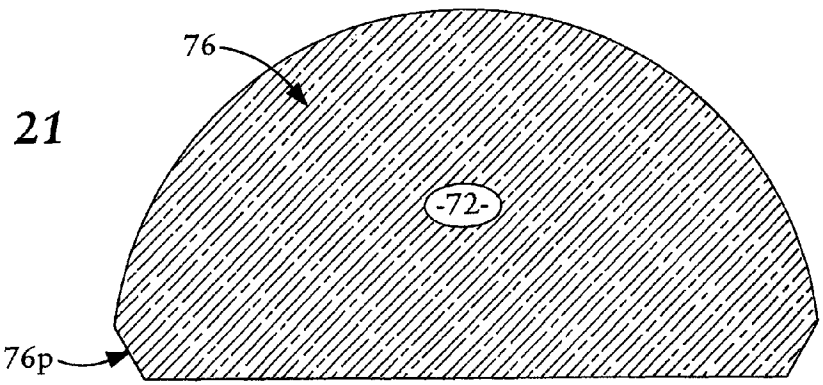
FIG. 21 is a cross-sectional view of a one-piece solid construction of the light transmissive structure, used in the fixture of FIG. 20.

As assembled to form the lighting fixture 1, the planar mounting section 11*p* of the flexible circuit board 11 is mounted on an attachment surface 13*p* of the heat sink member 13 having an inner edge 13*e* (corresponding to junction between surfaces 13*s* and 13*p*) at the inner peripheral portion of the heat sink member 13. The attachment surface 13*p* of the heat sink member 13 is substantially planar (and is therefore referred to as a "planar" surface), for convenience in this example. The planar mounting section 11*p* of the flexible circuit board 11 may be attached to the planar attachment surface 13*p* of the heat sink member 13 by an adhesive or glue or by any other cost-effective means. As described herein substantially planar surfaces or regions, such as "planar" surfaces 13*p* and/or 13*s* and the "planar" region 11*p* of the flexible circuit board 11, need not be perfectly flat but may be somewhat contoured, curved and/or textured. Also, although surfaces and/or sections such as 13*p* and 13*s* and 11*p* and 11*t* are shown at right angles, these angles are not critical, and the elements may be constructed at somewhat different angles as may be convenient for use with a transmissive structure 6 of a particular shape and/or to facilitate easy or efficient assembly of the lighting fixture 1. Reference is made to FIGS. 20 and 21, for an alternative example of a light transmissive structure 76.

In FIG. 3, the flexible tabs 11*t* are bent at a substantial angle with respect to the planar mounting section 11*p*, around the inner edge 13*e* of the surface 13*p* of the heat sink 13, by pressure of the solid state emitters 5 mounted on the tabs 11*t* against the outer peripheral portion 3*b* of the light transmissive structure 6. In the example of FIGS. 3 and 4, the tabs bend to form curved regions 11*c* around the edge 13*e*. A second surface 11*b* of each respective one of the tabs, opposite the first surface 11*a* of the respective tab, provides heat transfer to the heat sink member, to permit heat transfer from each solid state emitter on each respective tab to the heat sink member.

In the example of FIGS. 1 to 4, the fixture 1 also includes thermal interface material (TIM) 12 positioned between the second surface 11*b* of each tab 11*t* and a corresponding inner surface 13*s* of the heat sink member 13. The TIM 12, depending on the type of the emitter 5, can be insulative or conductive. The TIM 12, for example, can provide electrical insulation between the tabs 11*t* and the heat sink member 13, for example, for an implementation in which the heat slug of the emitter 5 is conductive. The TIM 12, however, can also provides thermal conductivity to the heat sink member 13. In the examples, pressure created by contact of the solid state light emitters 5 with the outer peripheral portion 3*b* of the light transmissive structure 6 compresses the TIM 12 against the surface 13*s* of the heat sink member 13.

Any of a variety of different techniques may be used to facilitate heat transfer from the emitter(s) 5 on a respective tab around, over or through the tab to the heat sink member 13. In the example of the lighting fixture 1, there are one or more vias formed through each respective tab 11*t*, from the first surface 11*a* of the respective tab to the second surface 11*b* of the respective tab 11*t* (FIG. 3). Heat conductive material 22 may extend through each via from the first surface 11*a* of the respective tab 11*t* to the second surface 11*b* of the respective tab, to conduct heat from each solid state emitter 5 on the respective tab 11*t*. In a typical implementation, heat conductive pads 21 and 23 are also formed on the first and second surfaces 11*a* and 11*b* of each tab 11*t*. The heat conductive pad 21 on the first surface 11*a* contacts the heat slug of the emitter 5 on the respective tab 11*t*. The heat conductive pad 23 on the second surface 11*b* contacts the surface 13*s* of the heat sink member 13. The heat conductive material 22 extending through the vias through the tab 11*t* conducts heat from each solid state emitter on the respective tab 11*t*, from the first pad 21 on the respective tab to the second pad 23 on the respective tab for transfer to the heat sink member 13, in this case, through the compressed TIM 12.

When assembled to form the lighting fixture 1, the angle between the tab end 11*t* holding the light emitter 5 with respect to the planar mounting section 11*p* of the flexible circuit board in the example roughly approaches a right angle. However, this angle is somewhat arbitrary. Different angles will be used in actual fixtures, particularly for different shapes of the light transmissive structure 6 and/or the heat sink member 13. FIG. 21 illustrates an example of a different shaped light transmissive structure 76. The angle may be somewhat acute or somewhat obtuse but is sufficient for the tabs 11*t* to appropriately position and hold the solid state light emitters 5 against the outer peripheral portion 3*b* of the light transmissive structure 6. The positioning of each emitter 5 in FIG. 1 provides an orientation in which a central axis of emission of the respective light emitter (shown as an arrow from each LED (L) in FIG. 1) is substantially parallel with respect to the reflector 9. In alternative examples, with appropriate contours for the solid 6 and the heat sink member 13, it may be possible to aim the emitters 5 away from the output surface 3 and somewhat toward the reflector 9*b*. Also, as shown in FIG. 20, with appropriate contours for the solid 76 (e.g. surface 76*p*) and the heat sink member 83, it is possible to aim the emitters 5 more toward the output surface 3 and somewhat away from the reflector 70.

As noted earlier, the drawings presented here as FIGS. 1 to 4 are somewhat stylized representations of a lighting fixture 1 utilizing a solid light transmissive structure 6, a flexible circuit board 11 and an optional heat sink member 13, which are useful in illustrating and teaching the technologies under consideration here. FIGS. 5 to 18 are various views of a fixture and components thereof implemented in accord with such teachings, and like reference numerals indicate substantially the same elements of that fixture as indicated in FIGS. 1 to 4 and discussed above. In view of these similarities, detailed discussion of the fixture of FIGS. 5 to 18 is omitted here. However, it may be helpful to consider a few supplemental points regarding the later fixture implementation illustrated by FIGS. 5 to 18. It is noted that in FIGS. 1-4 a substantially hemispherical light transmissive solid structure 6 is depicted, whereas FIGS. 5-18 assume a true hemispherical solid. The hemispherical solid in FIGS. 5 to 18 is replaceable with the "rivet" shaped light transmissive solid structure 6 of FIGS. 1-4.

Figure 12:
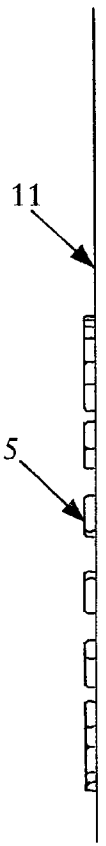
FIG. 12 is a side view of the flexible circuit board of FIG. 11.
Figure 11:
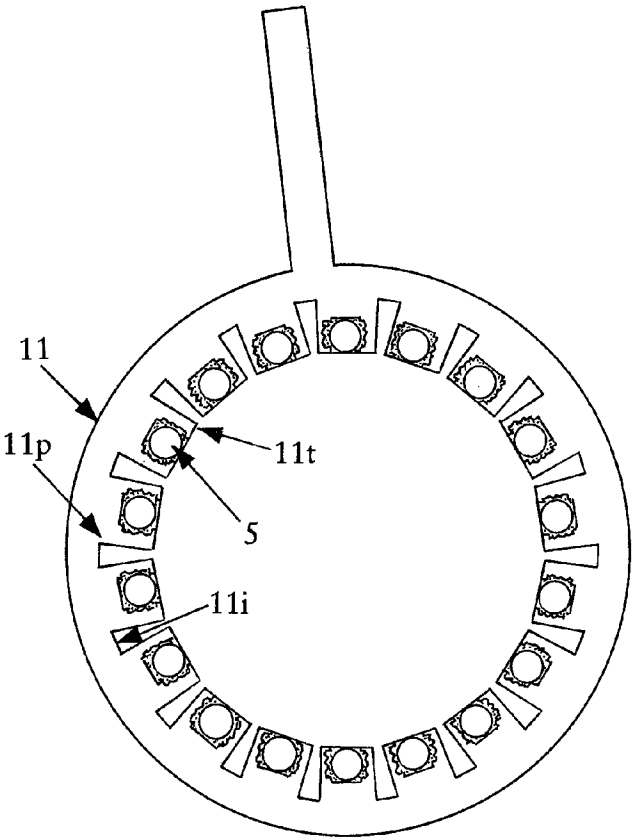
FIG. 11 is a plan view of the flexible circuit board used in the LED type lighting fixture of FIG. 5.
Figure 14:
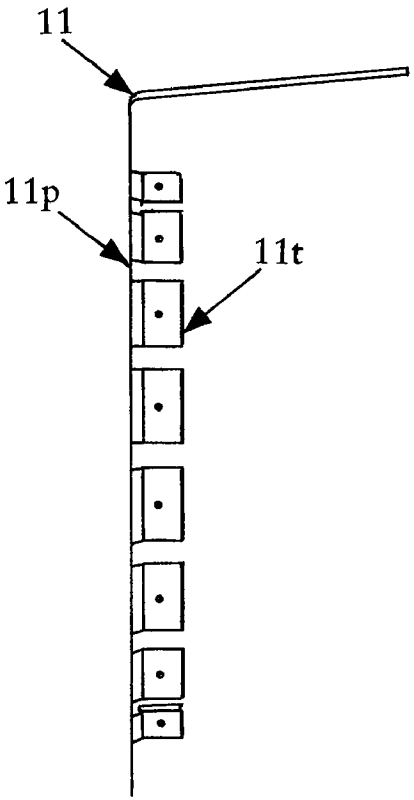
FIG. 14 is a side view of the flexible circuit board, but showing how flexible elements of the board are bent or curved as if installed in the LED type lighting fixture of FIG. 5.
Figure 13:
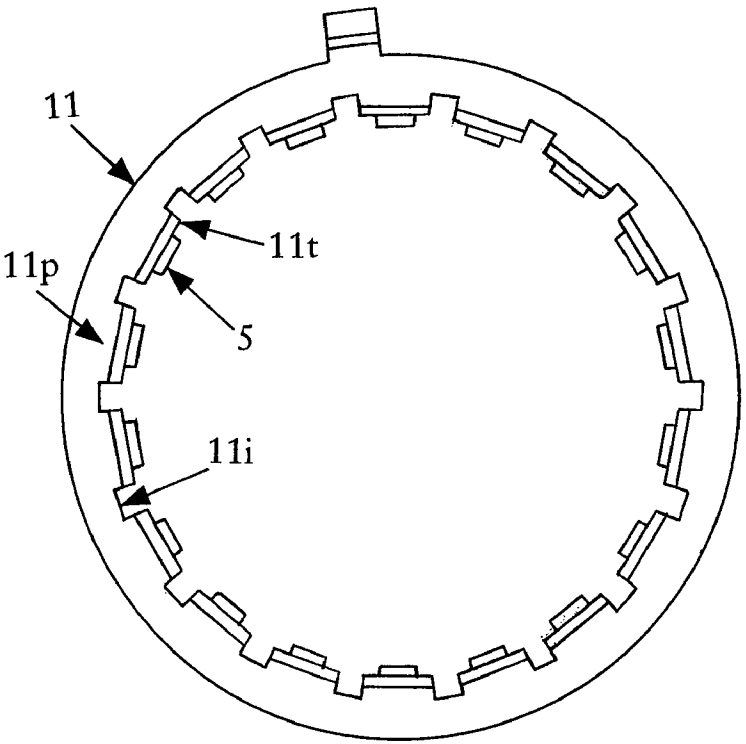
FIG. 13 is a plan view of the flexible circuit board, but showing how flexible elements of the board are bent or curved as if installed in the LED type lighting fixture of FIG. 5.
Figure 18:
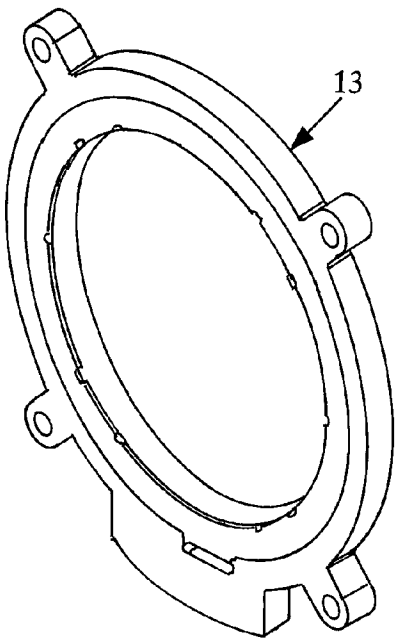
FIG. 18 is an isometric view of the heat sink ring of FIG. 15.
Figure 17:
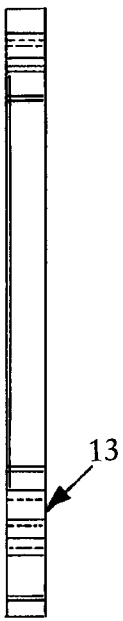
FIG. 17 is a side view of the heat sink ring of FIG. 15.
Figure 16:
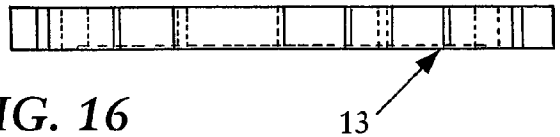
FIG. 16 is an end view of the heat sink ring of FIG. 15.
Figure 15:
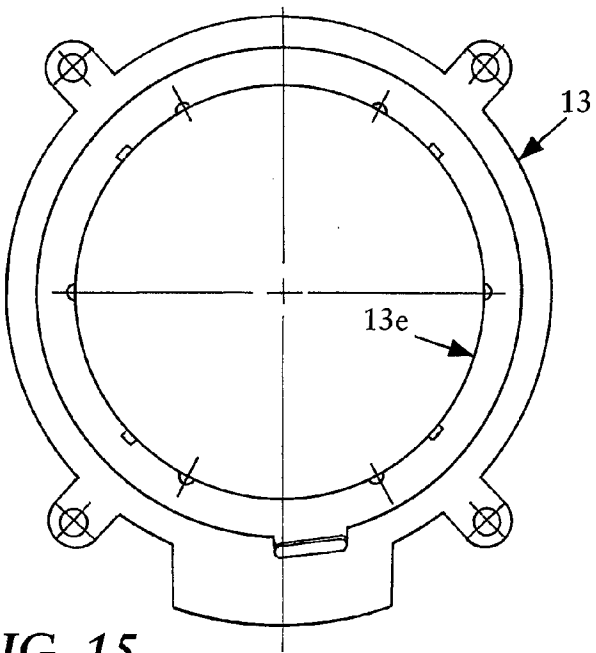
FIG. 15 is a bottom plan view of the heat sink ring of the LED type lighting fixture of FIG. 5.

For example, FIG. 11 is a plan view and FIG. 12 is a side view of the flexible circuit board 11, with LEDs 5 attached to the tabs 11*t*. In this example, there are 18 tabs and 18 LEDs. Before assembly, as shown in these two drawings, the tabs 11*t* are in a flat state, substantially co-planar with each other and with the rest of the flexible circuit board 11. FIG. 13 is a plan view and FIG. 14 is a side view of the flexible circuit board 11, in a state in which the tabs 11*t* are bent as if the board were installed around the light transmissive structure (although the structure is omitted here for ease of illustration).

A fixture of the type outlined above will typically form part of a lighting system, which includes circuitry for driving the solid state light emitters to generate light. In the example of FIGS. 5 to 18, the flexible circuit board 11 includes a strip extending away from the mounting section 11*p* of the flexible circuit board (see e.g. FIGS. 11 and 12). The strip provides the electrical connections to other elements of the circuitry. In such an implementation, the heat sink member 13 may include a passage, for example in an extension of the member 13, as shown in drawing figures such as FIGS. 15 and 18. The strip of the flexible circuit board can be bent with respect to the mounting section of the flexible circuit board (see e.g. FIGS. 13 and 14), to enable the strip to pass through the passage of the heat sink member (see e.g. FIGS. 6 and 8) to connect to the circuitry.

The present discussion encompasses a variety of different structural configurations for the light transmissive structure. In the examples shown and described above, the light transmissive structure comprises a single light transmissive solid 6 substantially filling the volume that forms the optical structure. A variety of other arrangements or configurations may be used to construct the light transmissive structure. As noted earlier, for example, materials containing phosphors may be provided within or around the solid. It may be helpful to consider an example or two.

A variety of conventional phosphors may be used. Recently developed quantum dot (Q-dot) phosphors or doped quantum dot (D-dot) phosphors may be used. Phosphors absorb excitation energy then re-emit the energy as radiation of a different wavelength than the initial excitation energy. For example, some phosphors produce a down-conversion referred to as a "Stokes shift," in which the emitted radiation has less quantum energy and thus a longer wavelength. Other phosphors produce an up-conversion or "Anti-Stokes shift," in which the emitted radiation has greater quantum energy and thus a shorter wavelength. Quantum dots (Q-dots) provide similar shifts in wavelengths of light. Quantum dots are nano scale semiconductor particles, typically crystalline in nature, which absorb light of one wavelength and re-emit light at a different wavelength, much like conventional phosphors. However, unlike conventional phosphors, optical properties of the quantum dots can be more easily tailored, for example, as a function of the size of the dots. In this way, for example, it is possible to adjust the absorption spectrum and/or the emission spectrum of the quantum dots by controlling crystal formation during the manufacturing process so as to change the size of the quantum dots. Thus, quantum dots of the same material, but with different sizes, can absorb and/or emit light of different colors. For at least some exemplary quantum dot materials, the larger the dots, the redder the spectrum of re-emitted light; whereas smaller dots produce a bluer spectrum of re-emitted light. Doped quantum dot (D-dot) phosphors are similar to quantum dots but are also doped in a manner similar to doping of a semiconductor. Also, Colloidal Q-Dots are commercially available from NN Labs of Fayetteville, Ark. and are based upon cadmium selenide and can be used with white solid state emitters (e.g. LEDs). Doped Q-dots are commercially available from NN Labs of Fayetteville, Ark. and are based upon manganese or copper-doped zinc selenide and can be used with near UV solid state emitters (e.g. LEDs).

The phosphors may be provided in the form of an ink or paint. As discussed above, the phosphor(s) can be applied to the cylindrical extension 3*b* of the structure 6. The phosphor can coat the housing of one or more of the solid state emitters 5, as well as the gap between the solid state emitters directly on the surface of the cylindrical extension 3*b* of the structure 6. The phosphors can be carried in a binder or other medium. The medium preferably is highly transparent (high transmissivity and/or low absorption to light of the relevant wavelengths). Although alcohol, vegetable oil or other media may be used, the medium may be a silicon material. If silicone is used, it may be in gel form or cured into a hardened form in the finished lighting fixture product. Another example of a suitable material, having D-dot type phosphors in a silicone medium, is available from NN Labs of Fayetteville, Ark. A Q-Dot product, applicable as an ink or paint, is available from QD Vision of Watertown Mass.

As noted, the present discussion encompasses a variety of different structural configurations for the light transmissive structure, but each produces a tailored output distribution as discussed above for the example in FIG. 1. With FIG. 22, instead of using a solid structure (e.g. FIG. 1) the light transmissive structure 6" may comprise a liquid filled container that is substantially the same shape as the structure 6 in FIG. 2. Although the container 15 could be a vacuum cavity, or filled with a gas, in the illustrated example, the container is filled with a liquid. The liquid or gas may contain a phosphor, such as one or more of the phosphors mentioned above. FIG. 22 is an example of a light transmissive structure 6" constructed in such a manner. As shown in FIG. 22, the light transmissive structure 6" includes a container 15. Although other container structures may be used, for ease of illustration, the exemplary container 15 exhibits high transmissivity and low absorption with respect to light of the relevant wavelengths. Although other materials could be used, to provide good containment and an excellent oxygen barrier, the example of FIG. 22 uses glass, preferably having an outer surface that has a roughened or etched texture (e.g. frosted).

In the example of FIG. 22, the container is filled with a liquid 66. The liquid could be transparent or translucent, with no active optical properties. However, for discussion purposes, the liquid 66 contains phosphor materials, including, but not limited to Q-dot or D-dot quantum type nano phosphors. Those skilled in the art will recognize that there are various ways to join the components of the container together to form a liquid tight and air tight seal, and that there are various ways to fill the container with the desired liquid in a manner that eliminates at least substantially all oxygen bearing gases. In the illustrated example, the liquid 66 substantially fills the volume of the container, with little or no gas entrained in the liquid 66.

The phosphors contained in the liquid 66 will be selected to facilitate a particular lighting application for the particular fixture. That is to say, for a given spectrum of light produced by the LEDs (L) and the diffusely reflective optical structure, the material and/or sizing of the nano phosphors or other phosphors will be such as to shift at least some of the light emerging through the aperture in a desired manner.

Nano phosphors are often produced in solution. Near the final production stage, the nano phosphors are contained in a liquid solvent. In a nano phosphor example, this liquid solution could be used as the solution 66 in the example of FIG. 22. However, the solvents tend to be rather volatile/flammable, and other liquids such as water or vegetable oil may be used. The phosphors may be contained in a dissolved state in solution, or the liquid and phosphors may form an emulsion. The liquid itself may be transparent, or the liquid may have a scattering or diffusing effect of its own (caused by an additional scattering agent in the liquid or by the translucent nature of the particular liquid).

The container 15 together with the liquid 66, substantially fill the optical volume 2, of the lighting fixture that incorporates the structure 6". External properties of the structure 6" will be similar to those of the structure 6 in the earlier examples. For example, the contoured surface, at least in regions where there is no contact to a solid state light emitter, may have a roughened or etched texture.

Figure 19:
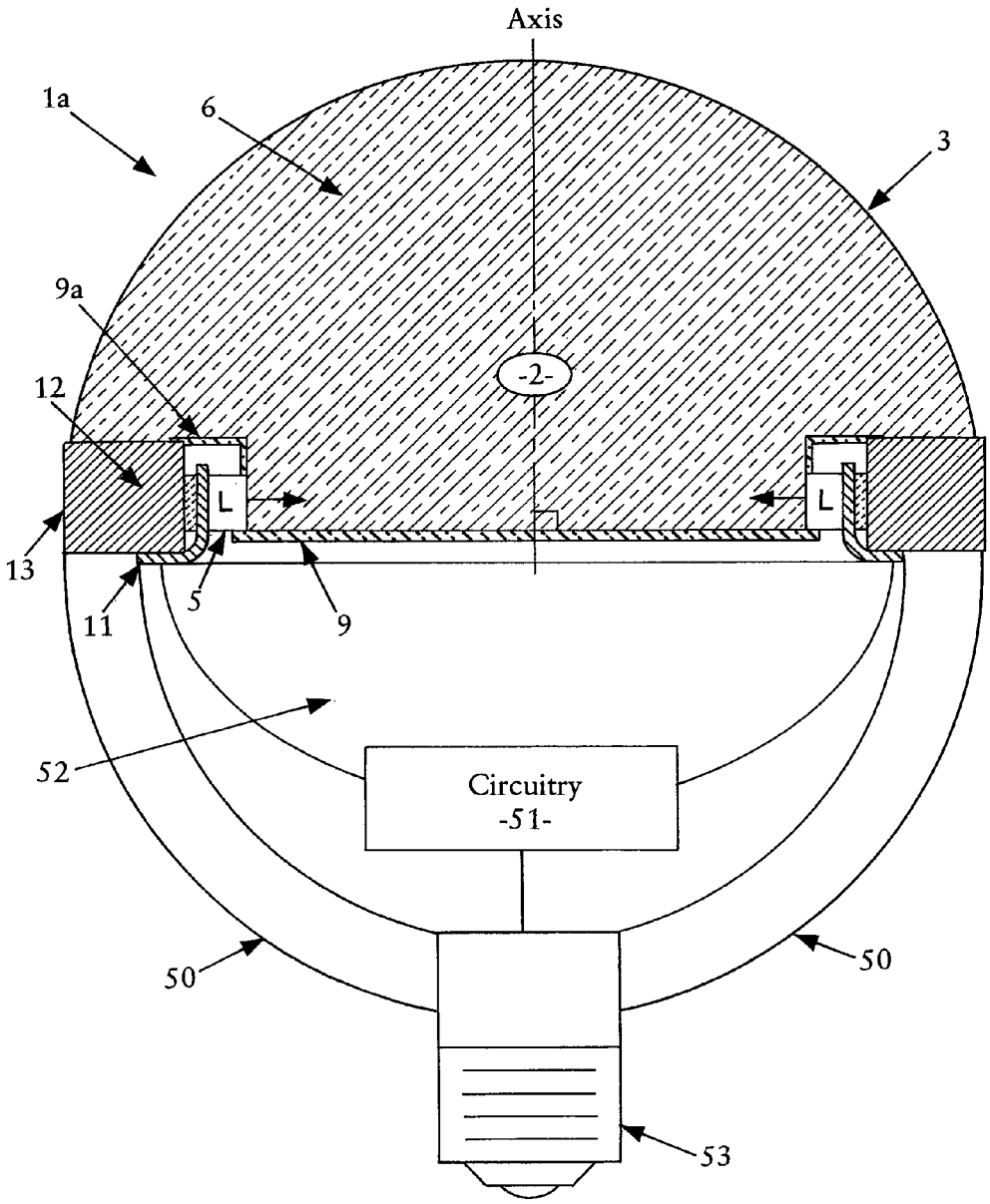
FIG. 19 is a cross-sectional view of a solid state light bulb, having a solid-filled optical structure, which is useful in explaining several of the concepts discussed herein.

Now turning to FIG. 19, an example of a light bulb in accordance with the present concepts is described. The upper portion of light bulb 1*a* substantially includes the elements describes above for lighting fixture 1. However, the light transmissive structure 6 shown in FIG. 19 is shaped such that it covers optional heat sink member 13. Moreover, the lower half of light bulb 1*a* contains a heat dissipation housing 52 positioned below the reflector and heat sink member 13. The exterior of the heat dissipation housing 52 includes a plurality of vertically extending cooling fins 50 positioned around the housing and physically coupled to the heat sink member 13. Cooling fins 50 aid in the dissipation of heat generated by solid state emitters 5. The base of housing 52 further includes a cap configured to be coupled with a light socket. In the example illustrated in FIG. 19, the cap is threaded for screwing into a light socket. Other types of connections such as metal prongs for insertion into a compatible light socket may be used in replace of the threaded cap shown in FIG. 19. Housing 52 further includes the circuitry 51. The solid state emitters 5 may be driven by any known or available circuitry that is sufficient to provide adequate power to drive the emitters at the level or levels appropriate to the particular lighting application of each particular fixture. A detailed example of such circuitry is described below with respect to FIG. 23. The light intensity distribution produced by light bulb 1*a* is substantially the same as that produced by lighting fixture 1 in FIG. 1. Thus, the distribution curve as a function of angle from the Axis takes the shape of a bat-wing.

Now turning to FIGS. 20 and 21, in lighting fixture 71, the planar mounting section 81*p* of the flexible circuit board 81 is mounted on an attachment surface of the optional heat sink member 83 having an inner edge corresponding to junction between angled inner surface and the mounting surface. In the illustrated downlight orientation (FIG. 22), attachment surface of the heat sink member is on the top side of the heat sink member. The mounting section of the flexible circuit board 81 may be attached to the planar attachment surface of the heat sink member 83 by an adhesive or glue or by any other cost-effective means. The flexible circuit board includes a strip 81*e*, extending away from the planar mounting section, for providing electrical connection(s) to the driver circuitry.

The flexible tabs 81*t* are bent at a substantial angle with respect to the mounting section of the heat sink member 81, around the inner edge of that surface, by pressure of the solid state emitters 75 mounted on the tabs 81*t* against the outer peripheral coupling surface 76*p* of the light transmissive structure 76. Each tab will bend to an angle approximately the same as the angle of the surfaces that it fits between, with respect to the diffusely reflective surface of reflector 70.

The tabs may be constructed in a manner similar to those in the earlier examples. The first surface of a tab 81*t* supports a solid state light emitter 75 and receives heat from the emitter. The tab 81*t* is constructed to conduct the heat from the solid state light emitter 75 to its opposite or second surface. The second surface of each respective one of the tabs provides heat transfer to the heat sink member 83, to permit heat transfer from each solid state emitter on each respective tab to the heat sink member.

In the example of FIG. 20, the fixture 71 also includes thermal interface material (TIM) 82 positioned between the second surface of each tab 81*t* and a corresponding inner surface of the heat sink member 83. The TIM 82, depending on the type of the emitter 75, can be insulative or conductive. The TIM 82, for example, can provide electrical insulation between the tabs 81*t* and the heat sink member 83, for example, for an implementation in which the heat slug of the emitter 75 is conductive. The TIM 82, however, can also provides thermal conductivity to the heat sink member 83. In the examples, pressure created by contact of the solid state light emitters 75 with the angled optical coupling surface 76*p* (FIG. 21) along the outer peripheral portion of the light transmissive structure 76 compresses the TIM 82 against the surface of the heat sink member 83.

The positioning of each emitter 75 provides an orientation in which a central axis of emission of the respective light emitter is at an l angle with respect to the surface of reflector 70. In this example (FIG. 20), the coupling surface 76*p* is at an angle away from the reflective surface 70*a* of reflector 70. Since, the central axis of emission of the respective light emitter 75 is substantially perpendicular to the coupling surface 76*p*, and the coupling surface 76*p* forms an obtuse angle (120°) relative to the reflector surface 70*a*. The central axis of emission of the respective light emitter 75 in this example is at an angle away from the reflector surface 70*a* and toward the aperture 73.

Although other angles may be used, the coupling surface 76*p* in the example forms an angle of approximately 120° with respect to the reflector surface 70*a*, therefore the angle between the central axis of emission of the respective light emitter 75 and the reflector surface 70*a* in this example is an acute angle or approximately 30°.

The lighting fixture examples 1 and 71 of FIGS. 1 and 20 are intended for use with other elements to form a commercial fixture that can be installed into a ceiling of a room or a wall and generate a tailored output distribution as discussed above. One or more housings can be securely fastened to another by way of bolts and thereby securely accommodate the lighting fixtures of FIGS. 1 and 20. The housing are formed of a good heat conductive material such as cast aluminum elements. Outer portions of one more housings can incorporate cooling fins. Heat from the solid state emitter 75 is transferred to the heat sink ring 81, as discussed earlier. From the ring 81, the heat travels to housings where it may be dissipated to the surrounding atmosphere via the cooling fins. To promote heat transfer from the heat sink member or ring 81 to the housings, the fixture may include adhesive TIM layers on the appropriate surfaces of the heat sink ring 81 (FIG. 20).

The solid state emitters in any of the fixtures discussed above may be driven by any known or available circuitry that is sufficient to provide adequate power to drive the emitters at the level or levels appropriate to the particular lighting application of each particular fixture. Analog and digital circuits for controlling operations and driving the emitters are contemplated. Those skilled in the art should be familiar with various suitable circuits. However, for completeness, we will discuss an example of suitable circuitry, with reference to FIG. 23. That drawing figure is a block diagram of an exemplary solid state lighting system 100, including the control circuitry and the LED type sold state light emitters utilized as a light engine 101 in a fixture or lighting apparatus of such a system. Those skilled in the art will recognize that the system 100 of FIG. 23 may include a number of the solid state light engines 101. The light engine(s) 101 could be incorporated into a fixture in any of the examples discussed above, with the LEDs shown in FIG. 23 serving as the various solid state emitters in the exemplary fixture and the connections thereto provided via the flexible circuit board.

Figure 23:
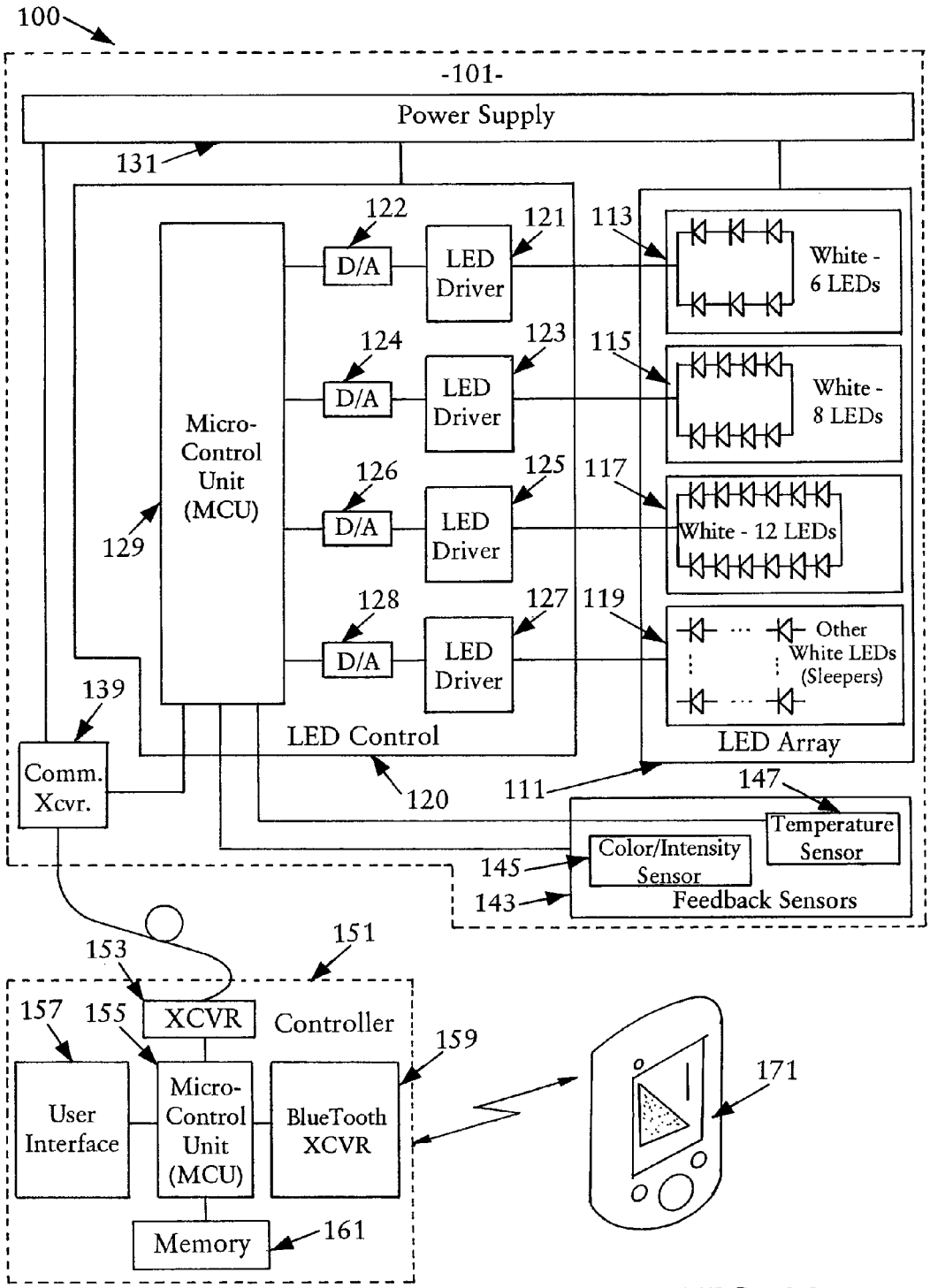
FIG. 23 is a functional block type circuit diagram, of an example of the solid state lighting elements as well as the driver circuitry, control and user interface elements which may be used with any of the lighting applications described herein.

The circuitry of FIG. 23 provides digital programmable control of the light. Those skilled in the art will recognize that simpler electronics may be used for some fixture configurations, for example, an all white LED fixture with little or no variability may have only a power supply and an ON/OFF switch.

In the light engine 101 of FIG. 23, the set of solid state sources of light takes the form of a LED array 111. A circuit similar to that of FIG. 23 has been used in the past, for example, for RGB type lighting (see e.g. U.S. Pat. No. 6,995,355) and could be used in a similar manner with LEDs of two or more colors. Different LED colors could be different primary colors or different color temperatures of white light. For a fixture that includes phosphors, the LEDs may be or include UV LEDs. However, for purposes of discussion of the main examples under consideration here, we will assume that the LEDs of the array 111 are all white LEDs rated for the same color temperature output.

Hence, the exemplary array 111 comprises one or more LEDs arranged in each of four different strings. Here, the array 111 includes three initially active strings of LEDs, represented by LED blocks 113, 115 and 117. The strings may have the same number of one or more LEDs, or the strings may have various combinations of different numbers of one or more LEDs. For purposes of discussion, we will assume that the first block or string of LEDs 113 comprises 6 LEDs. The LEDs may be connected in series, but in the example, two sets of 3 series connected LEDs are connected in parallel to form the block or string of 6 white LEDs 113. The LEDs may be considered as a first channel $C_1$, for control purposes.

In a similar fashion, the second block or string of LEDs 115 comprises 8 LEDs. The 8 LEDs may be connected in series, but in the example, two sets of 4 series connected LEDs are connected in parallel to form the block or string of 8 white LEDs 115. The third block or string of LEDs 117 comprises 12 LEDs. The 12 LEDs may be connected in series, but in the example, two sets of 6 series connected LEDs are connected in parallel to form the block or string of 12 white LEDs 117. The LEDs 115 may be considered as a second channel $C_2$, whereas the LEDs 117 may be considered as a third channel $C_3$, for control purposes.

The LED array 111 in this example also includes a number of additional or 'other' LEDs 119. As noted, some implementations may include various color LEDs, such as specific primary color LEDs, IR LEDs or UV LEDs, for various purposes. Another approach might use the LEDs 119 for a fourth channel to control output intensity. In the example, however, the additional LEDs 119 are 'sleepers.' Initially, the LEDs 113-117 would be generally active and operate in the normal range of intensity settings, whereas sleepers 119 initially would be inactive. Inactive LEDs are activated when needed, typically in response to feedback indicating a need for increased output (e.g. due to decreased performance of some or all of the originally active LEDs 113-117). The set of sleepers 119 may include any particular number and/or arrangement of the LEDs as deemed appropriate for a particular application.

Each string may be considered a solid state light emitting element coupled to supply light to the optical structure, where each such element or string comprises one or more light emitting diodes (LEDs) serving as individual solid state emitters. In the example of FIG. 23, each such element or string 113 to 119 comprises a plurality of LEDs.

The electrical components shown in FIG. 23 also include a LED control system 120 as part of the light engine 101. The system 120 includes driver circuits 121 to 127 for the various LEDs 113 to 119, associated digital to analog (D/A) converters 122 to 128 and a programmable micro-control unit (MCU) 129. The driver circuits 121 to 127 supply electrical current to the respective LEDs 113 to 119 to cause the LEDs to emit visible light or other light energy (e.g. IR or UV). Each of the driver circuits may be implemented by a switched power regulator (e.g. Buck converter), where the regulated output is controlled by the appropriate signal from a respective D/A converter. The driver circuit 121 drives the string of LEDs 113, the driver circuit 123 drives the string of LEDs 115, and the driver circuit 125 drives the string of LEDs 117. In a similar fashion, when active, the driver circuit 127 provides electrical current to the other LEDs 119. If the other LEDs provide a single color of light, and are connected together, there may be a single driver circuit 127. If the LEDs are sleepers, it may be desirable to provide a separate driver circuit 127 for each of the LEDs 119, for each of two or more sets of similar LEDs, or for each set of LEDs of a different color.

The driver circuits supply electrical current at the respective levels for the individual sets of LEDs 113-119 to cause the LEDs to emit light. The MCU 129 controls the LED driver circuit 121 via the D/A converter 122, and the MCU 129 controls the LED driver circuit 123 via the D/A converter 124. Similarly, the MCU 129 controls the LED driver circuit 125 via the D/A converter 126. The amount of the emitted light of a given LED set or string is related to the level of current supplied by the respective driver circuit, as set by the MCU 129 through the respective D/A converter. Although not shown, controlled switches may be provided to allow the MCU to selectively activate/deactivate each of the strings 113-119 of LEDs.

In a similar fashion, the MCU 129 controls the LED driver circuit 127 via the D/A converter 128. When active, the driver circuit 127 provides electrical current to the other LEDs 119. If the LEDs are sleepers, it may be desirable to provide a separate driver circuit and A/D converter pair, for each of the LEDs 119 or for other sets of LEDs of the individual primary colors.

In operation, one of the D/A converters receives a command for a particular level, from the MCU 129. In response, the converter generates a corresponding analog control signal, which causes the associated LED driver circuit to generate a corresponding power level to drive the particular string of LEDs. The LEDs of the string in turn output light of a corresponding intensity. The D/A converter will continue to output the particular analog level, to set the LED intensity in accord with the last command from the MCU 129, until the MCU 129 issues a new command to the particular D/A converter.

The control circuit could modulate outputs of the LEDs by modulating the respective drive signals. In the example, the intensity of the emitted light of a given LED is proportional to the level of current supplied by the respective driver circuit. The current output of each driver circuit is controlled by the higher level logic of the system. In this digital control example, that logic is implemented by the programmable MCU 129, although those skilled in the art will recognize that the logic could take other forms, such as discrete logic components, an application specific integrated circuit (ASIC), etc.

The LED driver circuits and the MCU 129 receive power from a power supply 131, which is connected to an appropriate power source (not separately shown). For most general lighting applications, the power source will be an AC line current source, however, some applications may utilize DC power from a battery or the like. The power supply 131 converts the voltage and current from the source to the levels needed by the various elements of the LED control 120.

A programmable microcontroller, such as the MCU 129, typically comprises a programmable processor and includes or has coupled thereto random-access memory (RAM) for storing data and read-only memory (ROM) and/or electrically erasable read only memory (EEROM) for storing control programming and any pre-defined operational parameters, such as pre-established routines. In a white light system, the routine might vary overall intensity with time over some set period. In a system using multiple different colors of LEDs, a light 'recipe' or 'routine' might provide dynamic color variation. The MCU 129 itself comprises registers and other components for implementing a central processing unit (CPU) and possibly an associated arithmetic logic unit. The CPU implements the program to process data in the desired manner and thereby generates desired control outputs to cause the system to generate a virtual source of a desired output characteristic.

The MCU 129 is programmed to control the LED driver circuits 121-127 to set the individual output intensities of the LEDs to desired levels in response to predefined commands, so that the combined light emitted from the optical aperture or passage of the integrating volume has a desired intensity. Dimming, for example, may utilize control of the intensities of the individual stings of LEDs in the array 111. It is also contemplated that the MCU may implement a step-wise dimming function by ON-OFF control of the strings of white LEDs in various combinations, as discussed in more detail in US Application Publication 2008/0224025 to Lyons et al. If there are two or more colors of white LEDs and/or different primary color LEDs, the intensity control by the MCU 129 may also control spectral characteristic(s) of the light output.

The electrical components may also include one or more feedback sensors 143, to provide system performance measurements as feedback signals to the control logic, implemented in this example by the MCU 129, to insure that the desired performance is maintained or to facilitate color control or the like. A variety of different sensors may be used, alone or in combination, for different applications. In the illustrated examples, the set 143 of feedback sensors includes a color and/or intensity sensor 145 and a temperature sensor 147. Although not shown, other sensors may be used. The sensors are positioned in or around the fixture to measure the appropriate physical condition, e.g. temperature, color, intensity, etc. One or both of the illustrated sensors could be mounted on the flexible circuit board, for example, on one or more of the tabs.

In a system using RGB or other combinations of multiple color LEDs, the sensor 145 could provide color distribution feedback to the MCU 129. For discussion of the all-white example, we will assume that the sensor 145 is an intensity sensor. The light sensor 145 therefore provides intensity information to the MCU 129. A variety of different sensors are available, for use as the sensor 145. The light sensor 145 is coupled to detect intensity of the light emitted through the aperture. The sensor 145 may be mounted alongside the LEDs for directly receiving light processed within the cavity. However, some small amount of the integrated light passes through a point on a wall of the cavity, e.g. through the Valar® reflector, therefore it may be sufficient to sense light intensity at that point on the cavity wall.

The MCU 129 uses the intensity feedback information to determine when to activate the sleeper LEDs 119. The intensity feedback information may also cause the MCU 129 to adjust the constant current levels applied to the LEDs 113 to 117 in the control channels $C_1$ to $C_3$, to provide some degree of compensation for declining performance before it becomes necessary to activate the sleepers 119.

The temperature sensor 147 may be a simple thermo-electric transducer with an associated analog to digital converter, or any of a variety of other temperature detectors may be used. The temperature sensor is positioned on or inside of the fixture, typically at a point that is near the LEDs or other sources that produce most of the system heat. The temperature sensor 147 provides a signal representing the measured temperature to the MCU 129. The system logic, here implemented by the MCU 129, can adjust intensity of one or more of the LEDs of array 111 in response to the sensed temperature, e.g. to reduce intensity of the source outputs to compensate for temperature increases. For example, if temperature is increasing due to increased drive current to the active LEDs (with increased age or heat), the controller may deactivate one or more of those LEDs and activate a corresponding number of the sleepers, since the newly activated sleeper(s) will provide similar output in response to lower current and thus produce less heat.

In a typical general lighting application, in say an architectural setting, the fixture and associated solid state light engine 101 will be mounted or otherwise installed at a location of desired illumination. The light engine 101, however, will be activated and controlled by a controller 151, which may be at a separate location. For example, if the fixture containing the light engine 101 is installed in the ceiling of a room as a downlight for a task or area illumination type application, the controller 151 might be mounted in a wall box near a door into the room, much like the mounting of a conventional ON-OFF or dimmer type wall switch for an incandescent or fluorescent lighting fixture. Those skilled in the art will recognize that the controller 151 may be mounted in close proximity to or integrated into the light engine 101. In some cases, the controller 151 may be at a substantial distance from fixture that incorporates the light engine. It is also conceivable that the separate controller 151 may be eliminated and the functionality implemented by a user interface on the light engine in combination with further programming of the MCU 129 (see e.g. the above cited U.S. Pat. No. 6,995,355).

The circuitry of the light engine 101 includes a wired communication interface or transceiver 139 that enables communications to and/or from a transceiver 153, which provides communications with the micro-control unit (MCU) 155 in the controller 151. Typically, the controller 151 will include one or more input and/or output elements for implementing a user interface 157. The user interface 157 may be as simple as a rotary switch or a set of pushbuttons, e.g. to control ON-OFF state and set the brightness or intensity level (dimming control). As another example, the controller 151 may also include a wireless transceiver, in this case, in the form of a Bluetooth transceiver 159. A number of light engines 101 of the type shown may connect over common wiring, so that one controller 151 through its transceiver 153 can provide instructions via interfaces 139 to the MCUs 129 in several such light engines, thereby providing common control of a number of lighting fixtures.

A programmable microcontroller, such as the MCU 155, typically comprises a programmable processor and includes or has coupled thereto random-access memory (RAM) for storing data and read-only memory (ROM) and/or electrically erasable read only memory (EEROM) for storing control programming and any pre-defined operational parameters, such as pre-established light 'routines.' In the example, the controller 151 is shown as having a memory 161, which will store programming and control data. The MCU 155 itself comprises registers and other components for implementing a central processing unit (CPU) and possibly an associated arithmetic logic unit. The CPU implements the program to process data in the desired manner and thereby generates desired control outputs to cause the controller 151 to generate commands to one or more light engines 100 to provide general lighting operations of the one or more controlled lighting fixtures.

The MCU 155 may be programmed to essentially establish and maintain or preset a desired 'recipe' or mixture of the intensities for the various LED light strings in array 111 to provide a selected overall output intensity or brightness. For a multi-color implementation, the MCU 155 may be programmed to essentially establish and maintain or preset a desired 'recipe' or mixture of the available wavelengths provided by the LEDs used in the particular system, to provide a desired spectral setting as well. For a given intensity setting (and/or color setting), the MCU 155 will cause the transceiver 139 to send the appropriate command or commands to the MCU 129 in the one or more light engines 101 under its control. Each fixture 1 incorporating such a light engine 101, which receives such an instruction, will implement the indicated setting and maintain the setting until instructed to change to a new setting. For some applications, the MCU 155 may work through a number of settings over a period of time in a manner defined by a dynamic routine. Data for such recipes or routines may be stored in the memory 161.

As noted, the controller 151 includes a Bluetooth type wireless transceiver 159 coupled to the MCU 155. The transceiver 159 supports two-way data communication in accord with the standard Bluetooth protocol. For purposes of the present discussion, this wireless communication link facilitates data communication with a personal digital assistant (PDA) 171. The PDA 171 is programmed to provide user input, programming and attendant program control of the system 100, for example, to allow a user to remotely control any number of the systems/fixtures.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A lighting fixture for providing a tailored light intensity distribution over a designated planar surface in a region or area intended to be occupied by a person, the fixture comprising:

a light transmissive structure forming a volume, the structure having:

a substantially contoured outer optical output surface, the outer optical output surface having a textured or etched output surface; and a peripheral portion positioned adjacent to the contoured outer optical output surface, the peripheral portion having an optical input surface;

a reflector having a diffusely reflective surface extending over at least a substantial portion of a surface of the light transmissive structure to form an optical structure including the volume of the light transmissive structure, the diffusely reflective surface facing outwardly towards the optical structure; and a plurality of solid state light emitters for producing light of sufficient intensity for illuminating the designated planar surface, the light produced by the solid state light emitters being diffused within the volume of the light transmissive structure and emitted through the contoured outer optical output surface of the light transmissive structure, wherein the light transmissive structure is contoured to distribute light having a distribution curve as a function of an angle from an axis, the axis having a 0° angle, and light intensity increasing toward 90° in either direction away from the axis.

2. The lighting fixture of claim 1, wherein:

the light transmissive structure comprises a light transmissive solid optionally containing one or more phosphors, and the light transmissive solid substantially fills the volume of the light transmissive structure.

3. The lighting fixture of claim 1, wherein the light transmissive structure comprises a container filled with a liquid, the liquid optionally containing one or more phosphors.

4. The lighting fixture of claim 1, further comprising:

a second reflector having a reflective surface facing inward with respect to the volume, positioned in proximity to an upper surface of each solid state light emitter.

5. The lighting fixture of claim 1 in combination with circuitry for driving the solid state light emitters to generate light.

6. The lighting fixture of claim 1, wherein the light transmissive structure comprises a light transmissive solid at least substantially filling the volume, the surface of the light transmissive structure over which the reflector extends is a surface of the solid opposite at least a portion of the optical output surface, and the reflective surface faces toward at least a portion of the optical output surface.

7. The lighting fixture of claim 1, further comprising a flexible circuit board, the flexible circuit board comprising:

(a) a mounting section having an inner peripheral portion of substantially similar shape and of a size slightly larger than the outer portion of the light transmissive structure, and (b) a plurality of flexible tabs attached to and extending from the inner peripheral region of the mounting section of the flexible circuit board.

8. The lighting fixture of claim 7, further comprising a heat sink member having an inner peripheral portion of substantially similar shape and of a size slightly larger than the peripheral portion of the light transmissive structure.

9. The lighting fixture of claim 1, wherein each solid state light emitter comprises a light emitting diode (LED).

10. The lighting fixture of claim 9, wherein each LED is a white LED.

11. A lighting fixture for providing a tailored light intensity distribution over a designated planar surface in a region or area intended to be occupied by a person, the fixture comprising:

a light transmissive structure forming a volume, the structure having:

a substantially contoured outer optical output surface, the outer optical output surface having a textured or etched output surface; and a peripheral portion positioned adjacent to the contoured outer optical output surface, the peripheral portion having an optical input surface;

a reflector having a diffusely reflective surface extending over at least a substantial portion of a surface of the light transmissive structure to form an optical structure including the volume of the light transmissive structure, the diffusely reflective surface facing outwardly towards the optical structure;

a heat sink member having an inner peripheral portion of substantially similar shape and of a size slightly larger than the peripheral portion of the light transmissive structure;

a flexible circuit board, the flexible circuit board comprising:

(a) a mounting section having an inner peripheral portion of substantially similar shape and of a size slightly larger than the outer portion of the light transmissive structure, and (b) a plurality of flexible tabs attached to and extending from the inner peripheral region of the mounting section of the flexible circuit board; and a plurality of solid state light emitters for producing light of sufficient intensity for illuminating the designated planar surface, the solid state light emitters being mounted on the flexible tabs, the light produced by the solid state light emitters being diffused within the volume of the light transmissive structure and emitted through the contoured outer optical output surface of the light transmissive structure, wherein the light transmissive structure is contoured to distribute light having a distribution curve as a function of an angle from an axis, the axis having a 0° angle, and light intensity increasing toward 90° in either direction away from the axis, the mounting section of the flexible circuit board is mounted on an attachment surface of the heat sink member, the attachment surface of the heat sink member having an inner edge at the inner peripheral portion of the heat sink member, the flexible tabs are bent at a substantial angle with respect to the mounting section of the flexible circuit board, around the inner edge of the attachment surface of the heat sink, by pressure of the solid state emitters mounted on the tabs against the input surface of the peripheral portion of the light transmissive structure, and a second surface of each respective one of the tabs, opposite the first surface of the respective tab, provides heat transfer to the heat sink member, to permit heat transfer from each solid state emitter on each respective tab to the heat sink member.

12. A lighting fixture for providing a tailored light intensity distribution over a designated planar surface in a region or area intended to be occupied by a person, the fixture comprising:

a light transmissive structure forming a volume, the structure having:

a substantially contoured outer optical output surface, the outer optical output surface having a textured or etched output surface; and a peripheral portion positioned adjacent to the contoured outer optical output surface, the peripheral portion having an optical input surface;

a reflector having a diffusely reflective surface extending over at least a substantial portion of a surface of the light transmissive structure to form an optical structure including the volume of the light transmissive structure, the diffusely reflective surface facing outwardly towards the optical structure; and a plurality of solid state light emitters for producing light of sufficient intensity for illuminating the designated planar surface, the solid state light emitters being mounted on the flexible tabs, the light produced by the solid state light emitters being diffused within the volume of the light transmissive structure and emitted through the contoured outer optical output surface of the light transmissive structure, wherein:

the light transmissive structure is contoured to distribute light having a distribution curve as a function of an angle from an axis, the axis having a 0° angle, and light intensity increasing toward 90° in either direction away from the axis, the solid state light emitters are positioned against the input surface of the peripheral portion of the light transmissive structure for emission of light in such an orientation that the central axis of emission of each light emitter is substantially:

parallel to the reflective surface of the reflector, at an acute angle relative to the reflector and inclined somewhat away from the reflector in a direction of the outer optical output surface, or at an obtuse angle relative to the reflector and declined somewhat toward the reflector in a direction away from the outer optical output surface.

13. The lighting fixture of claim 12, wherein:

the acute angle of the central axis of emission of each light emitter is approximately 60°, or the obtuse angle of the central axis of emission of each light emitter is approximately 120°.

14. A light bulb for providing a tailored light intensity distribution over a designated planar surface in a region or area intended to be occupied by a person, the light bulb comprising:

a light transmissive structure forming a volume, the structure having:

a substantially contoured outer optical output surface, the outer optical output surface having a textured or etched output surface; and a peripheral portion positioned adjacent to the contoured outer optical output surface, the peripheral portion having an optical input surface;

a reflector having a diffusely reflective surface extending over at least a substantial portion of a surface of the light transmissive structure to form an optical structure including the volume of the light transmissive structure, the diffusely reflective surface facing outwardly towards the optical structure;

a plurality of solid state light emitters for producing light of sufficient intensity for illuminating the designated planar surface, the light produced by the solid state light emitters being diffused within the volume of the light transmissive structure and emitted through the contoured outer optical output surface of the light transmissive structure; and a heat dissipation housing positioned below the reflector, wherein the exterior of the heat dissipation housing comprises a plurality of vertically extending cooling fins positioned around the housing, wherein the light transmissive structure is contoured to distribute light having a distribution curve as a function of an angle from an axis, the axis having a 0° angle, and light intensity increasing toward 90° in either direction away from the axis.

15. The light bulb of claim 14, further comprising a cap mounted below the heat dissipation housing and configured to be coupled with a light socket.

16. The light bulb of claim 14, wherein:

the light transmissive structure comprises a light transmissive solid, at least substantially filling the volume of the light transmissive structure and optionally containing one or more phosphors, or the light transmissive structure comprises a container filled with a liquid, the liquid optionally containing one or more phosphors.

17. The light bulb of claim 14, further comprising:

a second reflector having a reflective surface facing inward with respect to the volume, positioned in proximity to an upper surface of each solid state light emitter.

18. The light bulb of claim 14, further comprising a flexible circuit board, the flexible circuit board comprising:

(a) a mounting section having an inner peripheral portion of substantially similar shape and of a size slightly larger than the outer portion of the light transmissive structure, and (b) a plurality of flexible tabs attached to and extending from the inner peripheral region of the mounting section of the flexible circuit board.

19. The light bulb of claim 14, wherein each solid state light emitter comprises a light emitting diode (LED).

20. The light bulb of claim 19, wherein each LED is a white LED.

21. A light bulb for providing a tailored light intensity distribution over a designated planar surface in a region or area intended to be occupied by a person, the light bulb comprising:

a light transmissive structure forming a volume, the structure having:

a substantially contoured outer optical output surface, the outer optical output surface having a textured or etched output surface; and a peripheral portion positioned adjacent to the contoured outer optical output surface, the peripheral portion having an optical input surface;

a reflector having a diffusely reflective surface extending over at least a substantial portion of a surface of the light transmissive structure to form an optical structure including the volume of the light transmissive structure, the diffusely reflective surface facing outwardly towards the optical structure;

a flexible circuit board, the flexible circuit board comprising:

(a) a mounting section having an inner peripheral portion of substantially similar shape and of a size slightly larger than the outer portion of the light transmissive structure, and (b) a plurality of flexible tabs attached to and extending from the inner peripheral region of the mounting section of the flexible circuit board;

a plurality of solid state light emitters for producing light of sufficient intensity for illuminating the designated planar surface, the solid state light emitters being mounted on the flexible tabs, the light produced by the solid state light emitters being diffused within the volume of the light transmissive structure and emitted through the contoured outer optical output surface of the light transmissive structure;

a heat dissipation housing positioned below the reflector, wherein the exterior of the heat dissipation housing comprises a plurality of vertically extending cooling fins positioned around the housing; and a heat sink member, coupled to the cooling fins, having an inner peripheral portion of substantially similar shape and of a size slightly larger than the peripheral portion of the light transmissive structure, wherein the light transmissive structure is contoured to distribute light having a distribution curve as a function of an angle from an axis, the axis having a 0° angle, and light intensity increasing toward 90° in either direction away from the axis.

* * * * *